US011721299B2

(12) United States Patent
He

(10) Patent No.: US 11,721,299 B2
(45) Date of Patent: Aug. 8, 2023

(54) VIEWING ANGLE COMPENSATION METHOD OF DISPLAY PANEL AND DISPLAY PANEL

(71) Applicant: TCL China Star Optoelectronics Technology Co., Ltd., Guangdong (CN)

(72) Inventor: Jhenwei He, Shenzhen (CN)

(73) Assignee: TCL China Star Optoelectronics Technology Co., Ltd., Guangdong (CN)

( * ) Notice: Subject to any disclaimer, the term of this patent is extended or adjusted under 35 U.S.C. 154(b) by 311 days.

(21) Appl. No.: 16/972,701

(22) PCT Filed: Sep. 8, 2020

(86) PCT No.: PCT/CN2020/113991
§ 371 (c)(1),
(2) Date: Dec. 7, 2020

(87) PCT Pub. No.: WO2022/032780
PCT Pub. Date: Feb. 17, 2022

(65) Prior Publication Data

US 2022/0230598 A1 Jul. 21, 2022

(30) Foreign Application Priority Data

Aug. 11, 2020 (CN) ..... 202010801768.4

(51) Int. Cl.
*G09G 3/36* (2006.01)

(52) U.S. Cl.
CPC ... *G09G 3/3614* (2013.01); *G09G 2320/0233* (2013.01); *G09G 2320/068* (2013.01); *G09G 2320/0626* (2013.01)

(58) Field of Classification Search
CPC ..... G09G 3/3614; G09G 2320/0233; G09G 2320/068; G09G 2320/0626
See application file for complete search history.

(56) References Cited

U.S. PATENT DOCUMENTS

2003/0222836 A1 12/2003 Wong
2011/0315991 A1* 12/2011 Sugihara ..... G02F 1/136286 257/71
2012/0268504 A1* 10/2012 Irie ..... G09G 3/2025 345/209
2016/0085116 A1* 3/2016 Iwatsu ..... G02F 1/136286 349/144
2020/0159050 A1* 5/2020 Chung ..... G02F 1/134363

FOREIGN PATENT DOCUMENTS

CN 101872591 A 10/2010
CN 104898317 A 9/2015
CN 105093602 A 11/2015
CN 105869597 A 8/2016
CN 105093602 B * 3/2018 ..... G02F 1/133306
CN 108831399 A 11/2018
CN 108847194 A 11/2018

* cited by examiner

*Primary Examiner* — Kwang-Su Yang
(74) *Attorney, Agent, or Firm* — PV IP PC; Wei Te Chung; Zhigang Ma

(57) ABSTRACT

A viewing angle compensation method of a display panel and a display panel are provided. The method includes a step of providing a display panel, a step of setting data polarities, a step of performing grayscale transformation on grayscale values of successive frames, and a step of acquiring grayscale values of successive frames.

10 Claims, 5 Drawing Sheets

| | | | | | |
|---|---|---|---|---|---|
| 128 | 128 | 128 | 128 | 128 | 128 |
| 128 | 128 | 128 | 128 | 128 | 128 |
| 128 | 128 | 128 | 128 | 128 | 128 |
| 128 | 128 | 128 | 128 | 128 | 128 |

Before performing viewing angle compensation

→

| | | | | | |
|---|---|---|---|---|---|
| 180 | 50 | 180 | 50 | 180 | 50 |
| 50 | 180 | 50 | 180 | 50 | 180 |
| 180 | 50 | 180 | 50 | 180 | 50 |
| 50 | 180 | 50 | 180 | 50 | 180 |

After performing viewing angle compensation

VIEWING ANGLE COMPENSATION METHOD OF DISPLAY PANEL AND DISPLAY PANEL

FIELD OF DISCLOSURE

The present disclosure relates to the field of display technologies, and in particular to a viewing angle compensation method of a display panel and a display panel.

BACKGROUND

With a gradual improvement of a panel resolution, it has reached 8K (7680×4320) and above. In a case of the same panel size, an impact of an increase in resolution is that an aperture decreases and a transmission rate of the panel is reduced. Thus, an original viewing angle improvement solution (e.g., 8-domain design) cannot be applied to higher resolution products due to a loss of the transmittance. Instead of the 8-domain design, a 4-domain pixel structure is employed. However, it also leads to deterioration of viewing angle characteristics, and a viewing angle compensation is required to improve the viewing angle characteristics.

A negative effect of using the viewing angle compensation to improve the viewing angles is that it may result in granular sensation. Moreover, a liquid crystal reaction will correspond to grayscale values switching between different polarities, resulting in obvious vertical bright and dark stripes. Since these stripes can only be observed when user's head is shaking and a display screen is viewed from a side view, they are usually called vertical lines. Therefore, there will be this shortcoming in application.

FIG. 1 is a comparison chart of a side view brightness curve and a front view gamma curve of a display in the prior art. FIG. 2 is a schematic diagram of grayscale value changes of some pixels of a display before and after performing a viewing angle compensation adjustment in the prior art. As shown in FIG. 1, taking a viewing angle compensation (VAC) adjustment of 128 grayscale values as an example, look for a pair of HL grayscale values on the front view gamma curve. The H represents for a high grayscale value. The L represents for a low grayscale value. An average brightness of the HL grayscale values is equal to that of 128 grayscale values. FIG. 2 shows a data mapping before and after performing the viewing angle compensation under 128 grayscale values. If H=180 and L=50 that meet conditions are finally found, a point B at the 128 grayscale values on the side view gamma curve will be pushed down to a point C on the gamma curve. Principles of a point A and a point D are the same, thereby improving a problem of color drift in the side view. Pixels with a uniform value of 128 grayscale values before performing the viewing angle compensation is changed to two HL grayscale values of 128 and 50 at intervals after performing the viewing angle compensation, thereby improving the color drift in the side view. However, due to a different brightness of the HL grayscale values, it will cause granular sensation when viewing images.

A root cause of the obvious vertical bright and dark band stripes when viewed from the side is analyzed in combination with FIG. 1. A horizontal axis of FIG. 1 represents the grayscale values (gray level), and a vertical axis of FIG. 1 represents normalized luminance values. Gamma (GM) curves of side view and front view in FIG. 1 are inconsistent. The greater the difference between the gamma curves of the side view (off-axis) and the front view (on-axis), the worse the performance of the side view.

The vertical bright and dark stripes are particularly obvious in the side view, and a mechanism of improvement by a method in FIG. 2 is analyzed as follows. In terms of time, the same pixel is sequentially switched to the H grayscale value and the L grayscale value. The H represents for a high grayscale value, the L represents for a low grayscale value. Specifically, it can be H, L, H, L, etc. Alternatively, it can also be H, H, L, L, H, H, L, L, etc. After testing, there is no flicker observed by naked eyes when driving in a high frequency mode greater than 110 Hz, and flicker is visible when driving in a low frequency mode less than 110 Hz. FIG. 3 is a voltage waveform diagram of a pixel in four consecutive frames f1, f2, f3, and f4 in the prior art. As shown in FIG. 3, a driving voltage at the same pixel is switched between positive and negative polarities synchronously. This ensures that liquid crystal molecules will not be polarized. Also, every time it switches from the positive polarity to the negative polarity or from the negative polarity to the positive polarity, the voltage waveform will also change accordingly.

According to the voltages of the four consecutive frames f1, f2, f3, and f4 in FIG. 3, it can be seen that the pixel driving can only be realized when a voltage from the frame f1 to the frame f2 reaches a threshold voltage V1. It takes a certain amount of time to change from a voltage of the frame f1 to a voltage of the frame f2, which results in failure to reach a preset grayscale value in time and uneven brightness. Similarly, a principle of a voltage from the frame f2 to the frame f3 is the same. It takes a certain amount of time to change from a voltage of the frame f2 to a voltage of the frame f3, which results in failure to reach a preset grayscale value in time and uneven brightness.

FIG. 4 is a schematic diagram of a pixel array of two sequential frames of images in the prior art. In FIG. 4, each square represents a pixel, an H represents a high grayscale value, an L represents a low grayscale value, a symbol "+" represents a positive voltage, and symbol "−" represents a negative voltage. When each frame of image is switched, according to a polarity arrangement of pixels between frames, there are several switching possibilities for H and L of each pixel, including: H+→L−; H−→L+, H+→L+, H−→L−, L+→H−, L−→H+, L+→H+, and L−→H−. The grayscale values of L+ and L− are the same as that of H+ and H−. When the positive and negative voltages of each pixel are switched, their effective voltages are not consistent. Therefore, in fact, a response time of liquid crystal molecules is also inconsistent, so the following technical problems will occur. For example, when the grayscale value of a pixel is switched from L+ to H− or from L− to H+, a brightness of the pixel and the amount of brightness change are different. Similarly, when the grayscale value of a pixel is switched from H+ to L− or from H− to L+, the brightness of the pixel and the amount of brightness change are also different. Therefore, when user's head is shaking and a display screen is viewed from a side view, more obvious vertical bright and dark strips will be observed.

SUMMARY OF DISCLOSURE

In view of the shortcomings and disadvantages of the above prior art, the present disclosure provides a viewing angle compensation method of a display panel and a display panel. An overdrive method is proposed, and a plurality of sets of overdrive tables are used to solve the technical problem of uneven brightness of vertical bright and dark strips caused by an asymmetry of a liquid crystal response time when a grayscale value is switched between different polarities.

The present disclosure provides a viewing angle compensation method of a display panel, including: providing a display panel, wherein the display panel includes a plurality of pixel units arranged in an array, the pixel units include first-type pixel units and second-type pixel units, and the first-type pixel unit is adjacent to the second-type pixel unit; setting data polarities, wherein in a same frame, the first-type pixel unit and the second-type pixel unit have different data polarities; and wherein data polarities of a same pixel unit in two successive frames are different; performing grayscale transformation on grayscale values of successive frames, wherein grayscale values of the same pixel unit in the two successive frames are different; the first-type pixel units in a previous frame and the first-type pixel units in a next frame have different grayscale values; and the second-type pixel units in the previous frame and the second-type pixel units in the next frame have different grayscale values; and acquiring grayscale values of successive frames, wherein a pair of grayscale values on a front view gamma curve are acquired according to a preset brightness value, which are a first target grayscale value and a second target grayscale value; grayscale values of the first-type pixel unit and the second-type pixel unit in a first frame are respectively set to the first target grayscale value and the second target grayscale value; grayscale values of the first-type pixel unit and the second-type pixel unit in a second frame are respectively set to a first adjustment grayscale and a second adjustment grayscale; the first adjustment grayscale is an overload grayscale value that is biased to one side of the second target grayscale value along a changing trend when the first target grayscale value transforms to the second target grayscale value; the second adjustment grayscale is another overload grayscale value that is biased to one side of the first target grayscale value along the changing trend when the second target grayscale value transforms to the first target grayscale value; grayscale values of the first-type pixel units and the second-type pixel units in a third frame are respectively set to the second target grayscale value and the first target grayscale value; grayscale values of the first-type pixel units and the second-type pixel units in a fourth frame are respectively set to the second adjustment grayscale and the first adjustment grayscale; the first frame, the second frame, the third frame, the fourth frame are sequentially and cyclically processed; and when a brightness value of the second frame reaches the preset brightness value, it switches to the third frame, and when a brightness value of the fourth frame reaches the preset brightness value, it switches to the first frame.

Furthermore, the display panel includes a plurality of partitions, and each partition includes the pixel units with even numbered columns; in two adjacent partitions, data polarities of the first-type pixel units in the same frame are the same, and data polarities of the second-type pixel units in the same frame are the same; in the two successive frames, grayscale values of the first-type pixel units of two adjacent partitions are different; and in the two successive frames, grayscale values of the second-type pixel units of two adjacent partitions are different.

Furthermore, in the display panel, the first-type pixel unit is adjacent to the second-type pixel unit in a same row, and the first-type pixel unit is adjacent to the second-type pixel unit in a same column, the pixel units arranged in adjacent rows and adjacent columns are different from each other, and the first-type pixel units and the second-type pixel units are alternatively arranged.

Furthermore, each pixel unit is electrically connected to a data line, a data signal is input to the data line, and polarities of the data signal input to the data line are the data polarities.

Furthermore, the data polarities of the first-type pixel units and the second-type pixel units include positive and negative polarities.

Furthermore, in the step of setting the data polarities, a data polarity of the first-type pixel unit in the previous frame is opposite to a data polarity of the first-type pixel unit in the next frame, and a data polarity of the second-type pixel unit in the previous frame is opposite to a data polarity of the second-type pixel unit in the next frame.

Furthermore, in the step of performing grayscale transformation on the grayscale values of the successive frames, if a grayscale value of the first-type pixel unit in the previous frame is in a first grayscale range, a grayscale value of the first-type pixel units in the next frame is in a second grayscale range; and if a grayscale value of the second-type pixel unit is in the previous frame is in the second grayscale range, a grayscale value of the second-type pixel units in the next frame is in the second grayscale range.

Furthermore, in the step of acquiring the grayscale values of the successive frames, a plurality of sets of overdrive tables are provided, the plurality of sets of the overdrive tables are divided into positive/positive, positive/negative, negative/positive, and negative/negative according to the data polarities of the pixel units in the two successive frames; grayscale values in the plurality of sets of the overdrive tables include the first target grayscale value, the second target grayscale value, the first adjustment grayscale, and the second adjustment grayscale.

Furthermore, maximum grayscale values of the first target grayscale value, the second target grayscale value, the first adjustment grayscale, and the second adjustment grayscale include 128 or 255.

The present disclosure also provides a display panel, a manufacturing method of the display panel includes the viewing angle compensation method of the display panel as mentioned above.

Advantages of present disclosure are as follows. The viewing angle compensation method of the display panel and the display panel are provided. An overdrive method is employed, and a plurality of sets of overdrive tables are set in stages. The grayscale values of the pixels are rapidly increased or decreased by means of overload, so that a target voltage can quickly reach a required value. That is, a preset grayscale value can be reached in time, thereby improving brightness uniformity and avoiding vertical bright and dark band stripes.

DETAILED DESCRIPTION

The technical solutions in the embodiments of the present disclosure will be clearly and completely described below in conjunction with the drawings in the embodiments of the present disclosure. Apparently, the described embodiments are only a part of the embodiments of the present disclosure, rather than all the embodiments. Based on the embodiments in the present disclosure, all other embodiments obtained by those skilled in the art without creative efforts shall fall within the scope of protection of the present disclosure.

When a grayscale value is switched alternately for each consecutive frame at the same pixel, a driving voltage is switched accordingly. Thus, there will be repeated conversion from a low voltage value to a high voltage value, and then from a high voltage value to a low voltage value. In a process of voltage change, especially when changing from a low voltage value to a high voltage value, there is a long switching time, which results in the failure to reach a preset grayscale value in time and a brightness difference. If a target voltage can quickly reach a required value when the grayscale value is switched in consecutive frames, the preset grayscale value can be reached in time, thereby improving a brightness trend and avoiding vertical bright and dark stripes. Based on this, the present disclosure further provides an overdrive method, and a plurality of sets of overdrive tables are used to control the voltage to quickly reach the required value, so as to solve a technical problem of uneven brightness caused by an asymmetry of a liquid crystal response time when a grayscale value is switched between different polarities.

Figures 1, 2:
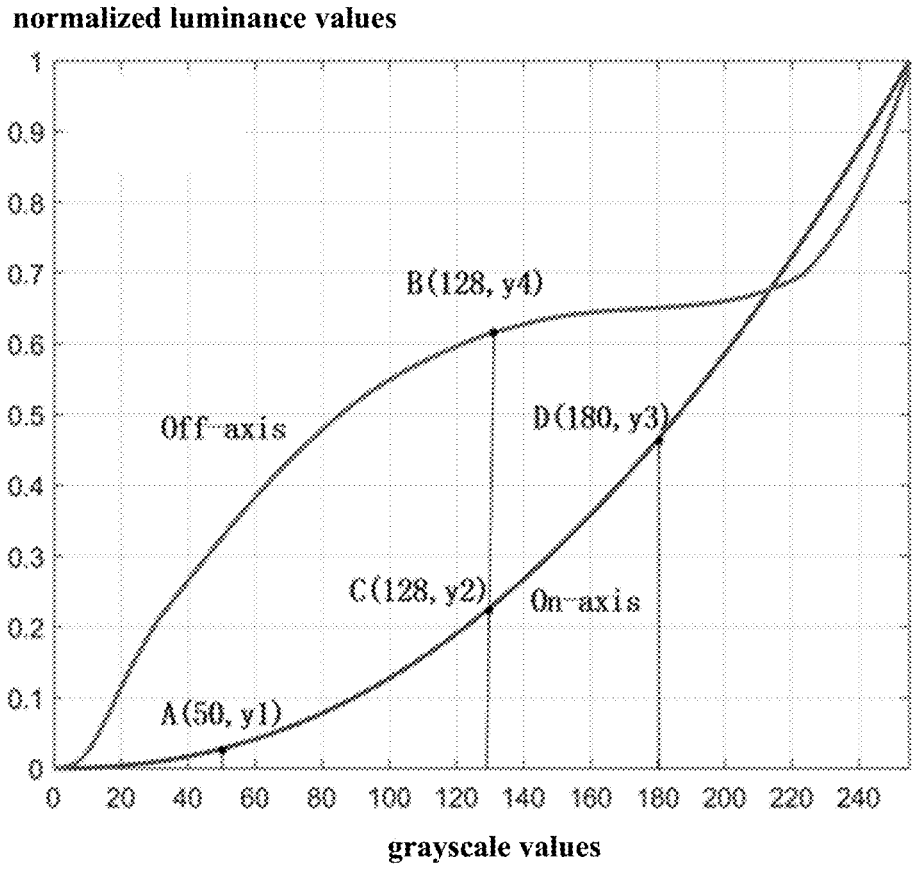
FIG. 1 (PRIOR ART)
FIG. 2 (PRIOR ART)
FIG. 1 is a comparison chart of a side view brightness curve and a front view gamma curve of a display in the prior art.
FIG. 2 is a schematic diagram of grayscale value changes of some pixels of a display before and after performing a viewing angle compensation adjustment in the prior art.
Figure 3:
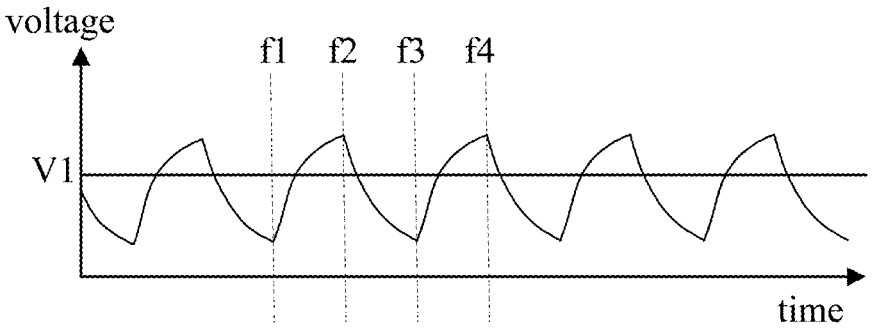
FIG. 3 (PRIOR ART)
FIG. 3 is a voltage waveform diagram of a pixel in four consecutive frames f1, f2, f3, and f4 in the prior art.
Figure 4:
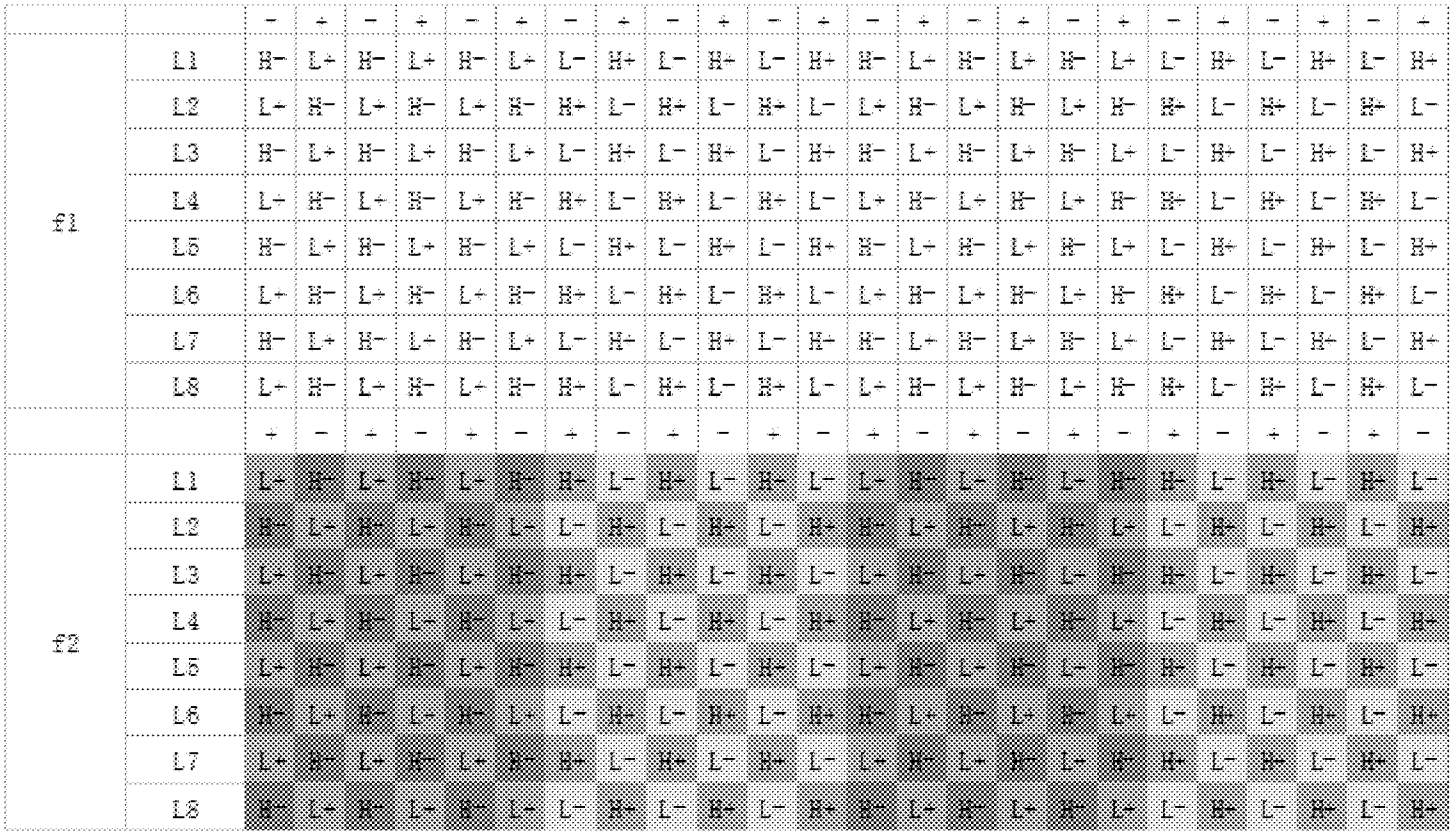
FIG. 4 (PRIOR ART)
FIG. 4 is a schematic diagram of a pixel array of two sequential frames of images in the prior art.
Figure 5:
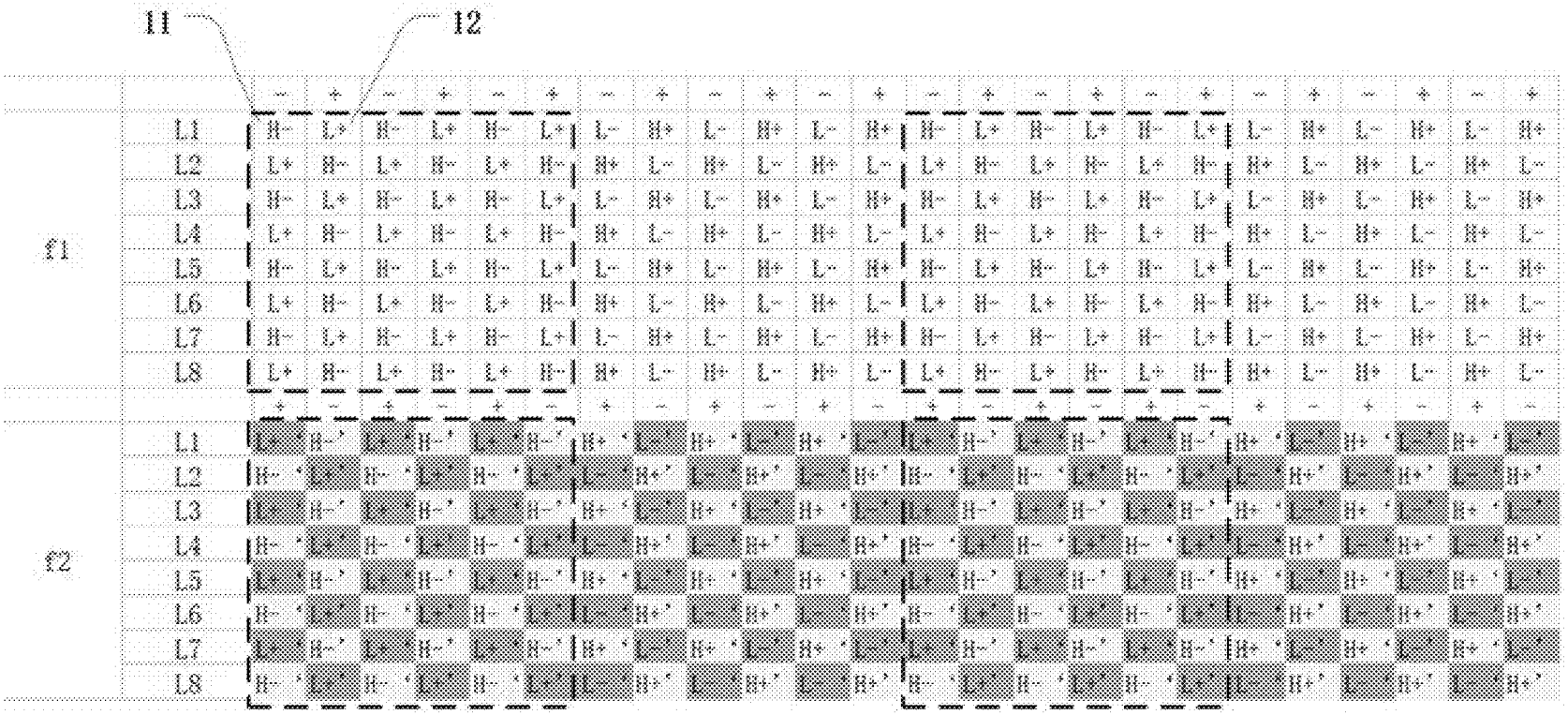
FIG. 5 is a schematic diagram of a pixel array of two sequential frames of images of a display panel of an embodiment of the present disclosure.

FIG. 5 is a schematic diagram of a pixel array of two sequential frames of images of a display panel of an embodiment of the present disclosure. As shown in FIG. 5, the present disclosure quickly raises or lowers grayscale values in an overload manner. That is, the grayscale values of L+, L−, H+, H− are quickly changed to H−', H+', L−', L+' which are targeted grayscale values H−, H+, L−, L+ that tend toward a direction of change. Then, when a brightness of a corresponding grayscale value in a change position reaches an expected brightness, that switch to the pre-changed targeted grayscale values of H−, H+, L−, L+. Satisfying the voltage can quickly reach the required value. The preset grayscale values can be reached in time, thereby improving the brightness trend and avoiding vertical bright and dark band stripes.

Figure 6:
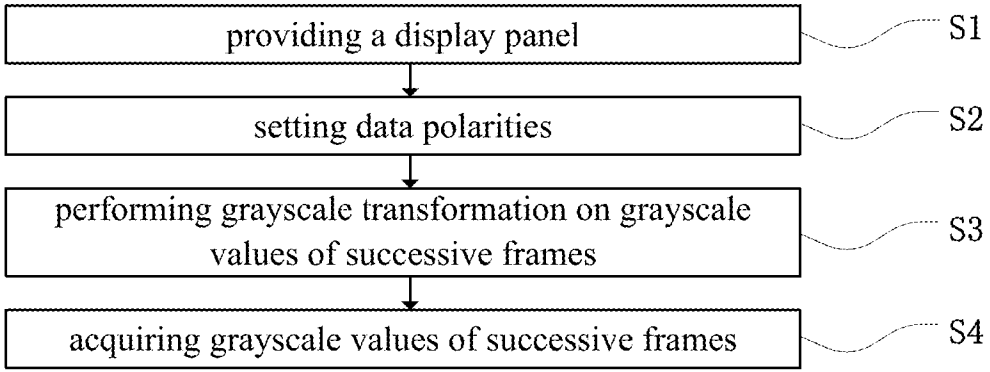
FIG. 6 is a flowchart of a viewing angle compensation method of a display panel of an embodiment of the present disclosure.

FIG. 6 is a flowchart of a viewing angle compensation method of a display panel of an embodiment of the present disclosure. As shown in FIG. 6, the viewing angle compensation method of the display panel includes the following steps S1-S4. It should be noted that a processing sequence of the step S2 and the step S3 is not strictly limited, and the step S2 and the step S3 can be performed simultaneously or the step S3 is performed earlier than the step S2.

In the step S1, a display panel is provided. The display panel includes a plurality of pixel units arranged in an array. The pixel units include first-type pixel units 11 and second-type pixel units 12, and the first-type pixel unit 11 is adjacent to the second-type pixel unit 12.

The first-type pixel units 11 and the second-type pixel units 12 are arranged adjacently in the same row, and the first-type pixel units 11 and the second-type pixel units 12 are arranged adjacently in the same column. Thus, the pixel units arranged in the adjacent rows and adjacent columns are different from each other, and the first-type pixel units 11 and the second-type pixel units 12 are alternatively arranged.

Each pixel unit is electrically connected to a data line. A data signal is input to one data line. Polarities of the data signals input to the data lines are called data polarities. The input data polarities of the first-type pixel units 11 and the second-type pixel units 12 include positive polarity and negative polarity.

In the step S2, the data polarities are set. In a same frame, the first-type pixel unit 11 and the second-type pixel unit 12 have different data polarities. Data polarities of a same pixel unit in two successive frames are different.

The data polarity of the first-type pixel units 11 input in the previous frame is opposite to the data polarity of the first-type pixel units 11 input in the next frame. The data polarity of the second-type pixel units 12 input in the previous frame is opposite to the data polarity of the second-type pixel units 12 input in the next frame.

If the data polarity of the first-type pixel units 11 input in a frame is positive, the data polarity of the second-type pixel units 12 input in the same frame is negative. Similarly, if the data polarity of the input first-type pixel units 11 in a frame is negative, the data polarity of the second-type pixel units 12 input in the same frame is positive.

In the step S3, a grayscale transformation on grayscale values of successive frames is performed. The grayscale values of the same pixel unit in the two successive frames are different. The first-type pixel units 11 in a previous frame and the first-type pixel units 11 in a next frame have different grayscale values. The second-type pixel units 12 in the previous frame and the second-type pixel units 12 in the next frame have different grayscale values.

If the grayscale value of the first-type pixel units 11 input in the previous frame is in a first grayscale range, the grayscale value of the first-type pixel units 11 input in the next frame is in a second grayscale range. If the grayscale value of the second-type pixel units 12 input in the previous frame is in the second grayscale range, the grayscale value of the second-type pixel units 12 input in the next frame is in the first grayscale range.

If the grayscale value of the first-type pixel units 11 input in a frame is in the first grayscale range, the grayscale value of the second-type pixel units 12 input in the same frame is in the second grayscale range. Similarly, if the grayscale value of the first-type pixel units 11 input in a frame is in the second grayscale range, the grayscale value of the second-type pixel units 12 input in the same frame is in the first grayscale range. The first grayscale range is a high grayscale value, represented by H, and the second grayscale range is a low grayscale value, represented by L.

In the step S4, the grayscale values of successive frames are acquired. The step S4 specifically includes steps S41-S46. In the step S41, a pair of grayscale values on a front view gamma curve are acquired according to a preset brightness value, which are a first target grayscale value and a second target grayscale value. In the step S42, grayscale values of the first-type pixel unit 11 and the second-type pixel unit 12 in a first frame are respectively set to the first target grayscale value and the second target grayscale value. In the step S43, grayscale values of the first-type pixel unit 11 and the second-type pixel unit 12 in a second frame are respectively set to a first adjustment grayscale and a second adjustment grayscale. The first adjustment grayscale is an overload grayscale value that is biased to one side of the second target grayscale value along a changing trend when the first target grayscale value transforms to the second target grayscale value. The second adjustment grayscale is another overload grayscale value that is biased to one side of the first target grayscale value along the changing trend when the second target grayscale value transforms to the first target grayscale value. In the step S44, grayscale values of the first-type pixel units 11 and the second-type pixel units 12 in a third frame are respectively set to the second target grayscale value and the first target grayscale value. In the step S45, grayscale values of the first-type pixel units 11 and the second-type pixel units 12 in a fourth frame are respectively set to the second adjustment grayscale and the first adjustment grayscale. In the step S46, the first frame, the second frame, the third frame, the fourth frame are sequentially and cyclically processed. When a brightness value of the second frame reaches the preset brightness value, it switches to the third frame, and when a brightness value of the fourth frame reaches the preset brightness value, it switches to the first frame.

Taking the change of the grayscale value from the first frame f1 to the second frame f2 in FIG. 5 as an example, when changing from the first frame f1 to the second frame f2, the grayscale value is quickly increased or decreased in an overload manner. That is, the grayscale values of L+, L−, H+, H− are quickly changed to H−', H+', L−', L+' which are targeted grayscale values H−, H+, L−, L+ that tend toward a direction of change. Then, when a brightness of a corresponding grayscale value in a change position reaches an expected brightness, that switch from the second frame f2 to the pre-changed targeted grayscale values of H−, H+, L−, L+ of the third frame f3. Similarly, if the third frame f3 is changed to the first frame f1, the grayscale value can be quickly increased or decreased by setting the overload manner of the fourth frame f4, so that the voltage can quickly reach the required value. The preset grayscale values can be reached in time, thereby improving the brightness trend and avoiding vertical bright and dark band stripes.

Table 1 is the grayscale value and brightness change table of each continuous frame. In Table 1, taking a viewing angle compensation (VAC) adjustment of 255 grayscale values as an example, a pair of HL grayscale values on the front view gamma curve are acquired. The H represents for a high grayscale value. The L represents for a low grayscale value. An average brightness of the HL grayscale values is equal to that of 128 grayscale values. If H=180 and L=50 that meet conditions are finally found, the target grayscale value is switched between 180 and 50. Taking the data of four consecutive frames f1, f2, f3, and f4 in Table 1 as an example, the first frame f1 is set to grayscale value 50, and an actual measured brightness corresponds to 50. The grayscale value 50 of the first frame f1 is pre-changed to the grayscale value 180 of the third frame f3. In order to ensure rapid changes in a short time, the second frame f2 with overload function is set between the first frame f1 and the third frame f3. A grayscale value of second frame f2 is set to 200. When the measured brightness of the first frame f1 changes from 50 to 180, the grayscale value 200 of the second frame f2 is switched to the grayscale value 180 of the third frame f3, and the brightness of the grayscale value is maintained at 180. The change from the third frame f3 to the first frame f1 of a next cycle is the same as above, the fourth frame f4 with overload function is set between the third frame f3 and the first frame f1 of the next cycle. The grayscale value of the fourth frame f4 is 35. The grayscale value 35 is a value that is less than the grayscale value 50 of the first frame f1 in the next cycle, which ensures that the brightness 180 of the grayscale value of the third frame f3 can quickly change to the brightness 50 of the grayscale value in a short time. When the measured brightness of the fourth frame f4 changes from 180 to 50, the grayscale value 200 of the fourth frame f4 is switched to the grayscale value 50 of the first frame f1 of the next cycle, and the brightness of the grayscale value is maintained at 50. That is, it realizes a periodic change with f1, f2, f3, and f4 as a cyclic order.

TABLE 1

| | successive frames | | | | |
|---|---|---|---|---|---|
| | f1 | f2 | f3 | f4 | f5 |
| actual measured brightness | 50 | 180 | 180 | 50 | 50 |
| changed grayscale value | 50 | 200 | 180 | 35 | 50 |

In this embodiment, in the step S4 of acquiring the grayscale values of the successive frames, a plurality of sets of overdrive tables are provided. The plurality of sets of the overdrive tables are divided into positive/positive, positive/negative, negative/positive, and negative/negative according to the data polarities of the pixel units in the two successive frames. The grayscale values in the plurality of sets of the overdrive tables include the first target grayscale value, the second target grayscale value, the first adjustment grayscale, and the second adjustment grayscale.

In this embodiment, maximum grayscale values of the first target grayscale value, the second target grayscale value, the first adjustment grayscale, and the second adjustment grayscale include 128 or 255. That is, the first target grayscale value, the second target grayscale value, the first adjustment grayscale, and the second adjustment grayscale range from 0-128 or 0-255. It is noted that the maximum grayscale values of the first target grayscale value, the second target grayscale value, the first adjustment grayscale, and the second adjustment grayscale are the same.

As shown in FIG. 5, in this embodiment, a plurality of partitions are provided in the display panel. Each partition includes the pixel units with even numbered columns. In two adjacent partitions, data polarities of the first-type pixel units 11 in the same frame are the same, and data polarities of the second-type pixel units 12 in the same frame are the same. In the two successive frames, grayscale values of the first-type pixel units 11 of two adjacent partitions are different. In the two successive frames, grayscale values of the second-type pixel units 12 of two adjacent partitions are different.

The present disclosure also provides a display panel, and its manufacturing method includes the viewing angle compensation method of the display panel described above.

Advantages of present disclosure are as follows. The viewing angle compensation method of the display panel and the display panel are provided. An overdrive method is employed, and a plurality of sets of overdrive tables are set in stages. The grayscale values of the pixels are rapidly increased or decreased by means of overload, so that a target voltage can quickly reach a required value. That is, a preset grayscale value can be reached in time, thereby improving brightness uniformity and avoiding vertical bright and dark band stripes.

The above are only preferred embodiments of present disclosure. It should be noted that for those of ordinary skill in the art, without departing from the principle of present disclosure, several improvements and modifications can be made, and these improvements and modifications should also be regarded as the protection scope of the present disclosure.

What is claimed is:

1. A viewing angle compensation method of a display panel, comprising:

providing a display panel, wherein: the display panel comprises a plurality of pixel units arranged in an array; the pixel units comprise first-type pixel units and second-type pixel units; and the first-type pixel unit is adjacent to the second-type pixel unit;

setting data polarities;

performing grayscale transformation on grayscale values of successive frames; and acquiring grayscale values of successive frames, wherein: a pair of grayscale values on a front view gamma curve are acquired according to a preset brightness value, which are a first target grayscale value and a second target grayscale value; grayscale values of the first-type pixel unit and the second-type pixel unit in a first frame are respectively set to the first target grayscale value and the second target grayscale value; grayscale values of the first-type pixel unit and the second-type pixel unit in a second frame are respectively set to a first adjustment grayscale and a second adjustment grayscale; the first adjustment grayscale is an overload grayscale value that is biased to one side of the second target grayscale value along a changing trend when the first target grayscale value transforms to the second target grayscale value; the second adjustment grayscale is another overload grayscale value that is biased to one side of the first target grayscale value along the changing trend when the second target grayscale value transforms to the first target grayscale value; grayscale values of the first-type pixel units and the second-type pixel units in a third frame are respectively set to the second target grayscale value and the first target grayscale value; grayscale values of the first-type pixel units and the second-type pixel units in a fourth frame are respectively set to the second adjustment grayscale and the first adjustment grayscale; the first frame, the second frame, the third frame, and the fourth frame are sequentially and cyclically processed; and when a brightness value of the second frame reaches the preset brightness value, the display panel switches to the third frame, and when a brightness value of the fourth frame reaches the preset brightness value, the display panel switches to the first frame, and wherein: the first frame is set to a grayscale value 50, an actual measured brightness of the first frame corresponds to the grayscale value 50, the grayscale value 50 of the first frame is pre-changed to a grayscale value 180 of the third frame, the second frame with overload function is set between the first frame and the third frame, a grayscale value of the second frame is set to 200; and when the actual measured brightness of the first frame changes from the grayscale value 50 to the grayscale value 180, the grayscale value 200 of the second frame is switched to the grayscale value 180 of the third frame, and an actual measured brightness of the second frame is at the grayscale value 180.

2. The viewing angle compensation method of the display panel as claimed in claim 1, wherein: the display panel comprises a plurality of partitions, and each partition comprises the pixel units with even numbered columns; in two adjacent partitions, data polarities of the first-type pixel units in the same frame are the same, and data polarities of the second-type pixel units in the same frame are the same; in the two successive frames, grayscale values of the first-type pixel units of two adjacent partitions are different; and in the two successive frames, grayscale values of the second-type pixel units of two adjacent partitions are different.

3. The viewing angle compensation method of the display panel as claimed in claim 1, wherein: in the display panel, the first-type pixel unit is adjacent to the second-type pixel unit in a same row; the first-type pixel unit is adjacent to the second-type pixel unit in a same column; the pixel units arranged in adjacent rows and adjacent columns are different from each other; and the first-type pixel units and the second-type pixel units are alternately arranged.

4. The viewing angle compensation method of the display panel as claimed in claim 1, wherein: each pixel unit is electrically connected to a data line; a data signal is input to the data line; and polarities of the data signal input to the data line are the data polarities.

5. The viewing angle compensation method of the display panel as claimed in claim 1, wherein the data polarities of the first-type pixel units and the second-type pixel units comprise positive and negative polarities.

6. The viewing angle compensation method of the display panel as claimed in claim 1, wherein: in the step of setting the data polarities, a data polarity of the first-type pixel unit in the previous frame is opposite to a data polarity of the first-type pixel unit in the next frame; and a data polarity of the second-type pixel unit in the previous frame is opposite to a data polarity of the second-type pixel unit in the next frame.

7. The viewing angle compensation method of the display panel as claimed in claim 1, wherein: in the step of performing grayscale transformation on the grayscale values of the successive frames, if a grayscale value of the first-type pixel unit in the previous frame is in a first grayscale range, a grayscale value of the first-type pixel units in the next frame is in a second grayscale range; and if a grayscale value of the second-type pixel unit is in the previous frame is in the second grayscale range; a grayscale value of the second-type pixel units in the next frame is in the first grayscale range.

8. The viewing angle compensation method of the display panel as claimed in claim 1, wherein: in the step of acquiring the grayscale values of the successive frames, a plurality of sets of overdrive tables are provided, the plurality of sets of the overdrive tables are divided into positive/positive, positive/negative, negative/positive, and negative/negative according to the data polarities of the pixel units in the two successive frames; and grayscale values in the plurality of sets of the overdrive tables comprise the first target grayscale value, the second target grayscale value, the first adjustment grayscale, and the second adjustment grayscale.

9. The viewing angle compensation method of the display panel as claimed in claim 1, wherein maximum grayscale values of the first target grayscale value, the second target grayscale value, the first adjustment grayscale, and the second adjustment grayscale comprise 128 or 255.

10. A display panel, wherein a manufacturing method of the display panel comprises the viewing angle compensation method of the display panel as claimed in claim 1.

* * * * *